US005429256A

United States Patent [19]

Kestenbaum

[11] Patent Number: 5,429,256

[45] Date of Patent: Jul. 4, 1995

[54] DRUG WITHDRAWAL SYSTEM FOR CONTAINER

[76] Inventor: Alan D. Kestenbaum, 1 Scott La., Purchase, N.Y. 10577

[21] Appl. No.: 185,254

[22] Filed: Jan. 24, 1994

[51] Int. Cl.[6] ..... A61J 1/18; B65D 41/18; B65D 51/22

[52] U.S. Cl. ..... 215/247; 215/321; 215/DIG. 3; 220/377; 604/403; 604/411

[58] Field of Search ..... 215/247, 249, 250, 251, 215/DIG. 3; 141/27, 319, 329, 383; 604/82, 86, 88, 89, 91, 411, 410, 403; 220/377; 206/459.1

[56] References Cited

U.S. PATENT DOCUMENTS

| | | | |
|---|---|---|---|
| 4,412,623 | 11/1983 | Schmidt | 215/247 X |
| 4,576,211 | 3/1986 | Valentini et al. | 141/329 |
| 4,792,053 | 12/1988 | Towns et al. | 220/377 X |
| 4,834,149 | 5/1989 | Fournier et al. | 141/329 X |
| 4,834,152 | 5/1989 | Howson et al. | 141/329 X |
| 4,884,703 | 12/1989 | O'Meara | 215/250 X |
| 4,909,290 | 3/1990 | Coccia | 141/329 |
| 5,006,118 | 4/1991 | Yule | 141/27 X |
| 5,088,996 | 2/1992 | Kopfer et al. | 141/329 X |
| 5,171,214 | 12/1992 | Kolber et al. | 215/247 X |

*Primary Examiner*—Allan N. Shoap
*Assistant Examiner*—Nathan J. Newhouse
*Attorney, Agent, or Firm*—Martin J. Spellman, Jr.

[57] ABSTRACT

Apparatus for withdrawing medicine from a vial with a needle penetrable to gasket. The apparatus snap fits on top of the vial. Inner walls of the apparatus chassis are connected at their base to the lower end of a cylindrical hollow adapter, a cylindrical hollow holds the ferrule with a sharp lance at the bottom is slidable within the hollow ferrule from a recessed position to a forward position to penetrate the vial gasket. A lance at the lower end of the ferrule penetrates the gasket only when a syringe, without a needle, is screwed on the adapter end and driving the ferrule lance through the gasket to establish flow communication with the syringe. A cap with a window for determining if the device has been used previously is provided.

5 Claims, 6 Drawing Sheets

FIG.8
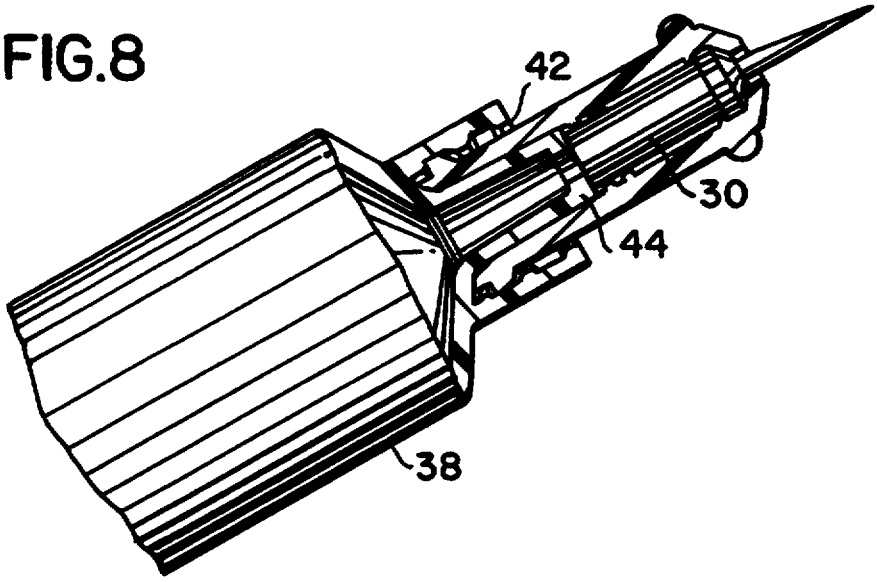
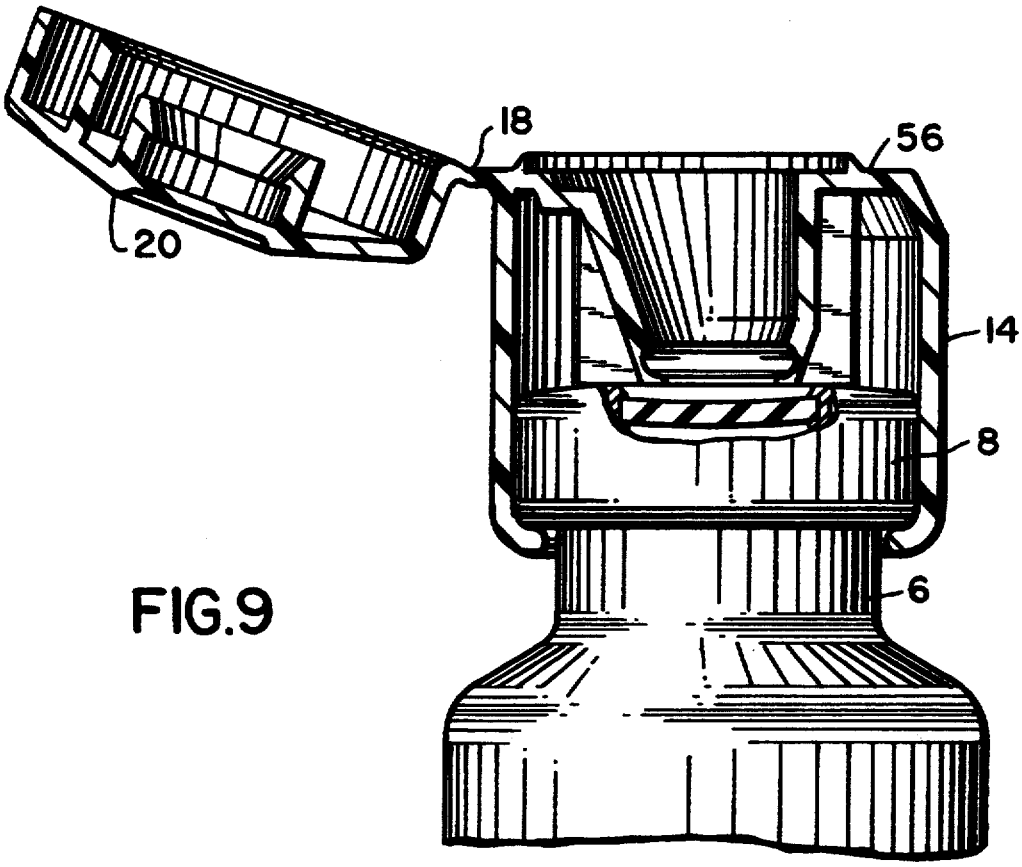
FIG.9

DRUG WITHDRAWAL SYSTEM FOR CONTAINER

BACKGROUND OF THE INVENTION

1. Field of the Invention

The present invention is concerned with containers for some liquid pharmaceutical products and more particularly for a safe cap closure for such containers. It is presently common practice for the containers or bottles of liquid, pharmaceuticals that are intended to be administered intravenously or otherwise to a patient through a needle into the patient have a rubber stopper to which a needle attached to a syringe is inserted and the medicine withdrawn with the syringe. This often exposes the medical worker to accidental pricks by the syringe needle with the risk of contamination of the needle as well as exposure of the worker to blood transmitted diseases such as AIDS. The present invention provides a medicine container closure that maintains the medicine uncontaminated, but provides a means in which a syringe can be utilized to withdraw the medicine from the container without utilization of a separate needle on the syringe. This is accomplished by providing a Luer lock connection at the end of a hard plastic Luer lock adaptor which at a first inner end may snap on and off the specially designed container cap that is attached to a standard medicine container and at a second outer end may be connected to the Luer connector of a standard syringe. Within the central section of the generally cylindrical adapter is a plastic ferrule with a hollow lance at its inner end in flow communication with its outer end which bears against the opening of the syringe where connected.

The ferrule is normally at the outer end of the adapter, but when a syringe is connected it advances within the adapter automatically piercing the rubber seal of the container and allows medicine to be withdrawn into the syringe.

2. Prior Art

In U.S. Pat. No. 29,656, Chittenden, et al, transfer containers provided having a stopper closure with a removable cover and the slidable lance or piercing unit that may be pushed against the rubber seal of one container, puncturing the rubber seal of that container. Simultaneously, it slides to the second position within the tone structure and against the stopper of its own container piercing the rubber seal of that first container, providing flow communication between the two containers.

In U.S. Pat. No. 4,128,098, Bloom, et al, discloses a vial transfer device utilizing a valve spike structure component of tubular construction and a syringe coupler supported on the spike. The coupler carries a special collapsible valve member that opens upon insertion of a blunt syringe tip into the coupler and closes upon removal of the syringe tip. Transfer device is secured to the vial by protective skirt with snap lugs to engage and secure the device to the vial. Other references of background interest in this field are as follows:

| U.S. PAT. | INVENTOR | OWNED BY |
|---|---|---|
| U.S. PAT. 2,667,986 | Perelson | — |
| U.S. PAT. 3,872,992 | Larson | Pharmaco, Inc. |
| U.S. PAT. 3,999,543 | Lacey | Illinois Tool Works Inc. |
| U.S. PAT. 4,169,475 | Genese | Abbott Laboratories |
| U.S. PAT. 4,210,623 | Breno et al | Ownes-Illinois, Inc. |
| U.S. PAT. 4,768,568 | Fournier et al | Survival Technology, Inc. |

-continued

| U.S. PAT. | INVENTOR | OWNED BY |
|---|---|---|
| U.S. PAT. 4,610,374 | Buehler | Dougherty Brothers Company |

SUMMARY OF THE INVENTION

The present invention provides a convenient, simple, and safe means of withdrawing medicine from a vial container and minimizes the chances of an accidental needle prick.

The apparatus for withdrawing medicine from the vial container which has the usual needle penetrable gasket on its top includes a chassis with depending outer walls. The outer walls have an inwardly extending shoulder at their base and are flexible enough to snap onto the neck of the medicine vial.

The chassis has inner walls which depend from the top of the chassis towards the gasket on the top of the vial and are connected to the lower ends of a cylindrical Luer lock adapter. The connection may be fixed, but is preferably a releasable snap structure cooperating with releasable connectors on the adapter.

The outer surface near the upper end of said adapter has male Luer lock threads to enable a syringe with Luer lock connector to be releasably secured to the apparatus.

A cylindrical ferrule assembly is movable from a recessed position within the adapter to an extended position therein when a syringe is screwed onto the adapter outer end. The inner end of the ferrule has a hollow lance which advances through the gasket into flow communication with the vial contents and the syringe when the syringe is attached to the adapter. Optionally the ferrule may be spring biased to the recessed position after use.

The ferrule is preferably made of a colored plastic. The chassis is provided with a cover cap attached to it by a plastic hinge. The cap has a translucent window in the center thereof to view the outer end of the ferrule. When clearly visible, this indicates the ferrule is in the recessed position and the absence of a spring to return the ferrule to the recessed position after use, when it is clearly visible through the cap window shows the vial gasket has not been pierced.

The parts are all made of molded plastic with sufficient flexibility for the snap-on features.

After the syringe is screwed onto the adapter and the lance punctures the gasket of the vial, the medicine is withdrawn into the syringe and the adapter unsnapped and removed from the apparatus and the medicine transferred from the syringe. The adapter is then snapped back into the chassis, the syringe disconnected, and the cap closed to preserve sterility.

BRIEF DESCRIPTION OF THE DRAWING

In the accompanying drawings which form a part of this specification

FIG. 8 shows the syringe removed from the special cap of the present invention and the adapter and ferrule engaged with the syringe;

FIG. 9 shows the chassis and cap of the present invention with ferrule and adapters removed therefrom;

ILLUSTRATIVE SPECIFIC EMBODIMENT

Figure 1:
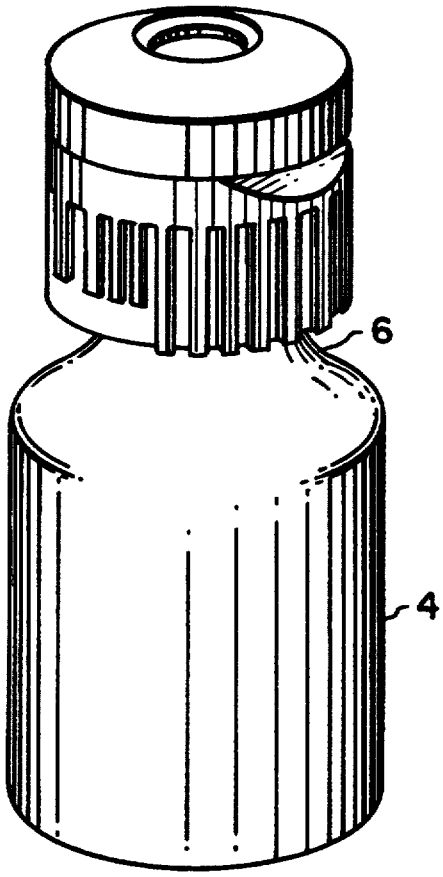
FIG. 1 is an overall perspective view the device of the present invention in place on the top of a medicine vial which has not been used previously used.
Figure 2:
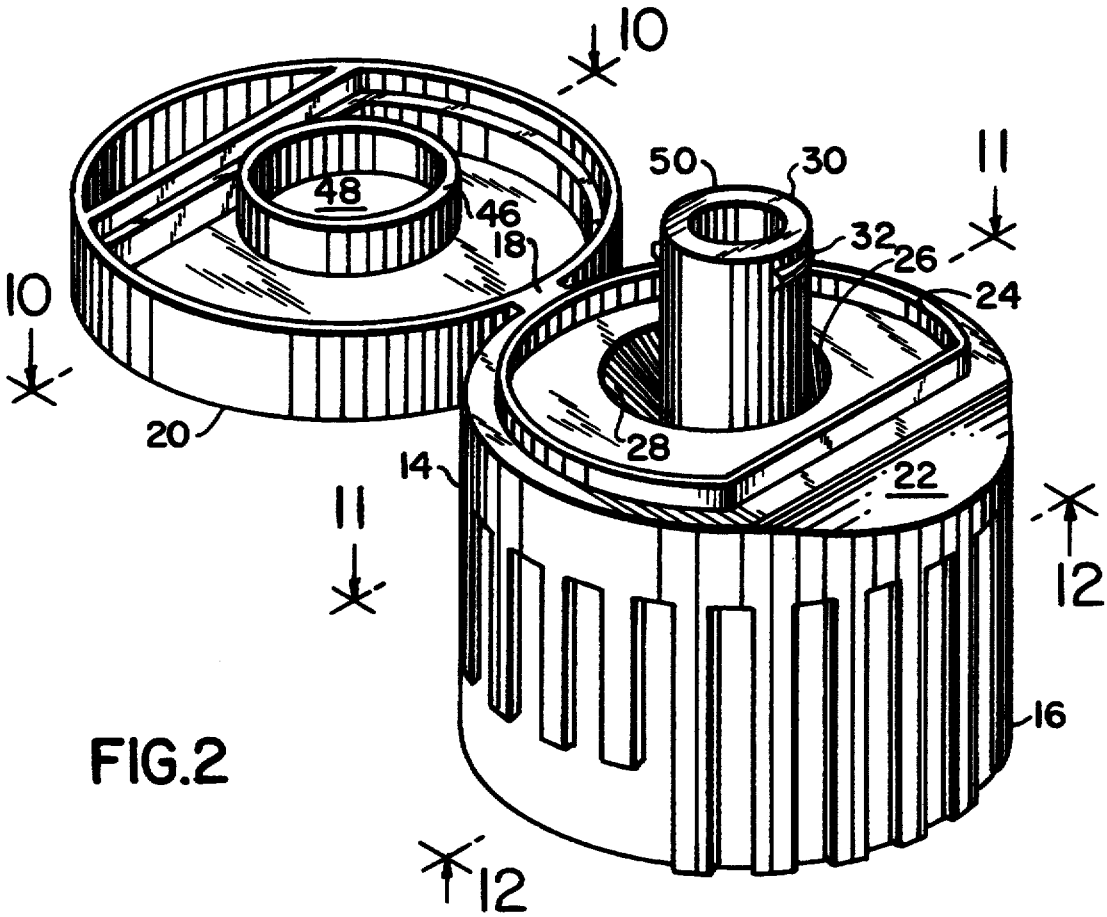
FIG. 2 is a perspective of the invention with the top of the device opened.
Figure 3:
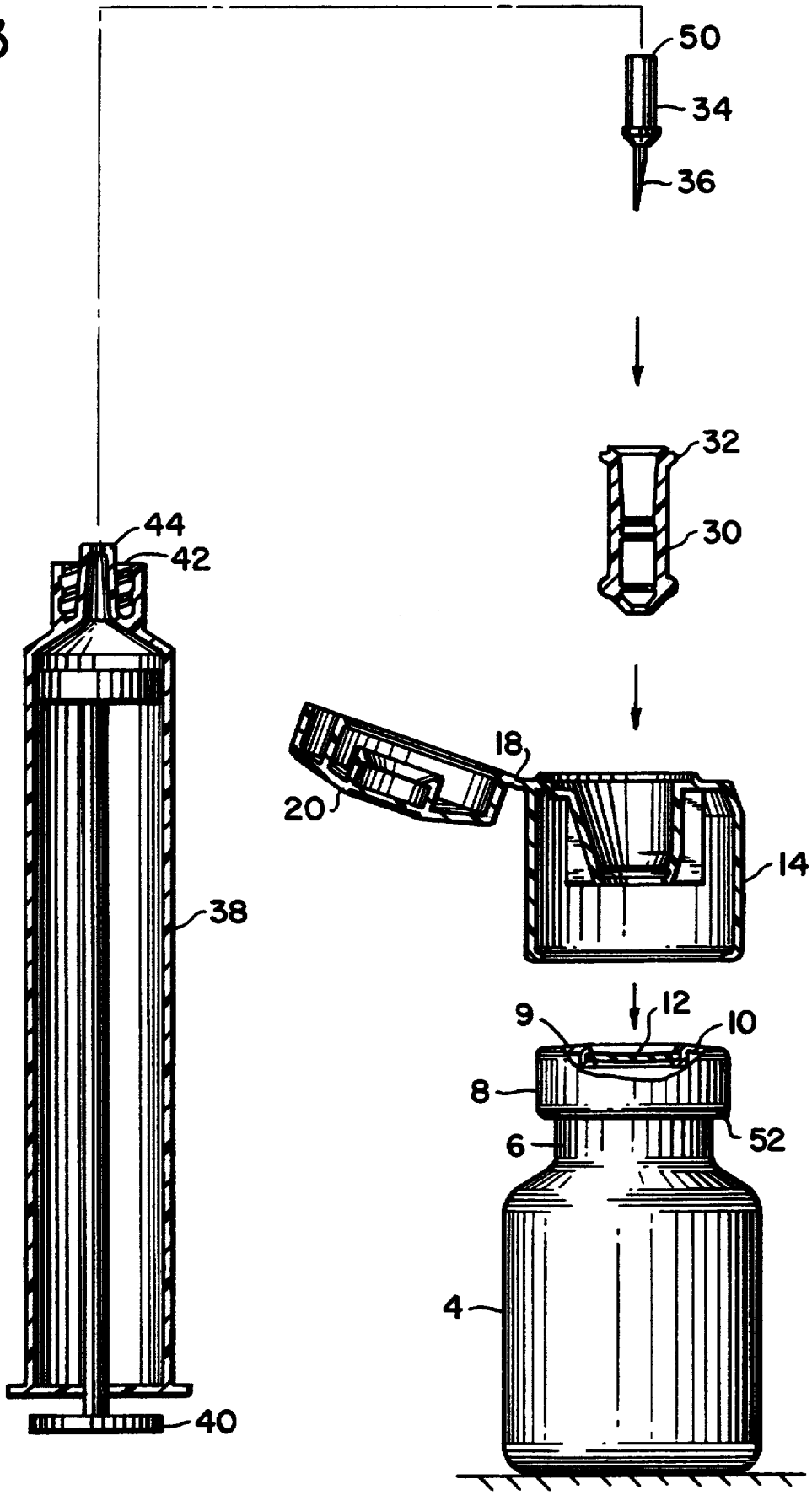
FIG. 3 is an expanded of the components of the device of the present invention, partially in section with a standard sealed medicine vial and syringe with female Luer lock.

Referring to FIG. 1 of the accompanying drawing the device of the present invention is indicated in general by 2 and is engaged to the top of the medicine vial 4 having a closure neck 6. The neck 6 flares out at 8 as shown in FIG. 3 in a conventional manner. The top of the bottle or vial 8 has a recessed portion 10 on the top 9 which is closed by rubberized gasket 12 which is of the conventional self-sealing type that is usually punctured by syringe needles.

The device 2 includes the generally cylindrical chassis 14 having vertical groves 16 on the external sides to facilitate handling. A living hinge 18 securing the cap 20 to the chassis 14 on the side thereof. The parts are integrally molded from plastic. The top of the chassis 14 has an inclined portion 22, vertical shoulder 24 and central opening 26. The wall section 28 adjacent the cap 20 is inclined away from the center towards the cap 20.

Figure 4:
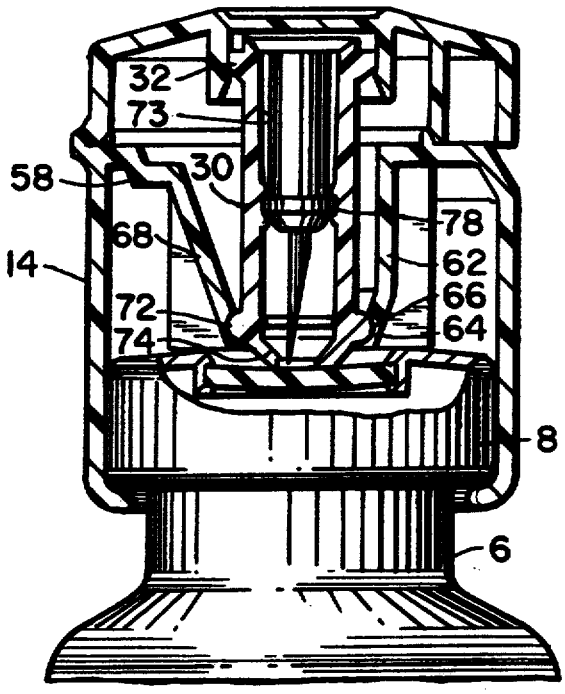
FIG. 4 is a side view, partially in section, showing the device of the present invention in place on the top of the medicine vial with the top cap of the device closed.

Referring to FIGS. 3 and FIG. 4, the device 2 also includes a Luer lock adapter 30 having external threads 32 thereon and a ferrule structure 34, the lower end of which has the hollow sharpened lance 36.

In use, the device is secured to a syringe 38 having a conventional plunger 40, a female Luer lock connector 42, and the syringe shaft 44. The cap 20 is provided with a walled opening 46 in which is secured a translucent window 48 which as later described will indicate the position of the ferrule 34 by the degree that the color coding 50 on the top of the ferrule 34 is seen through the translucent window 48.

The lower portion of the chassis 14 outer walls has an inwardly descending ledge or lip 54 which snaps in place on the under side 4 of the flared top 8 of the medicine container or vial 4.

The Luer lock adapter 30 is removably snap fitted into recesses 66 in the base of inner wall 64 of the chassis 14. The portion 68 of walls 64 adjacent hinge 18 is outwardly angled as shown clearly in FIG. 4. The annular wall 70 of the adapter 30 at its lower end has an annular outwardly extending ridge or bulge 72 which slide-snaps into the recess 66. Below a bulge 72, the section 74 extends downwardly and as shown at 76 bears against the top surface 76 of the gasket 12.

Figure 5:
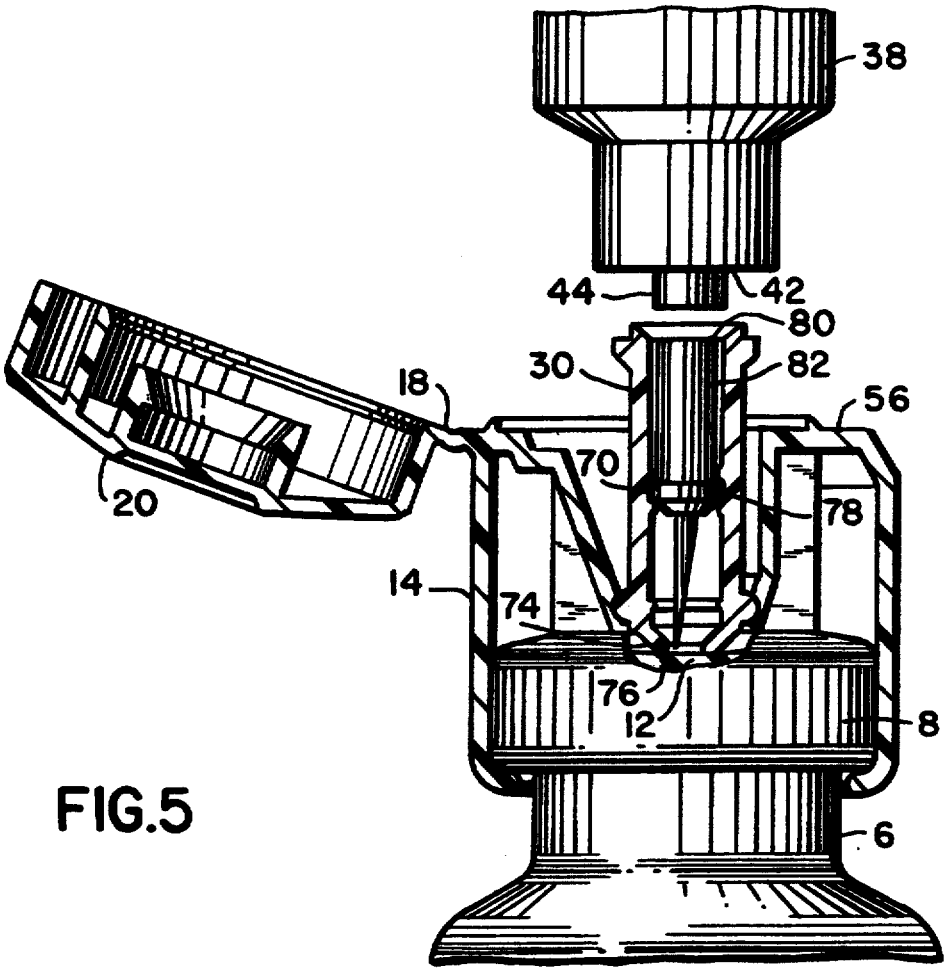
FIG. 5 also is a side view, partially in section, with the cap of the device opened and the syringe about to engage the outer end of the Luer lock adapter of the device.

As shown also in FIG. 4, the inner side 73 of the wall 70 tapers outwardly and upwardly to allow the ferrule 34 to slide downwardly therein and has a collar 78 for the ferrule 34 to wedge against the walls 70 at the point shown as FIG. 5.

Figure 6:
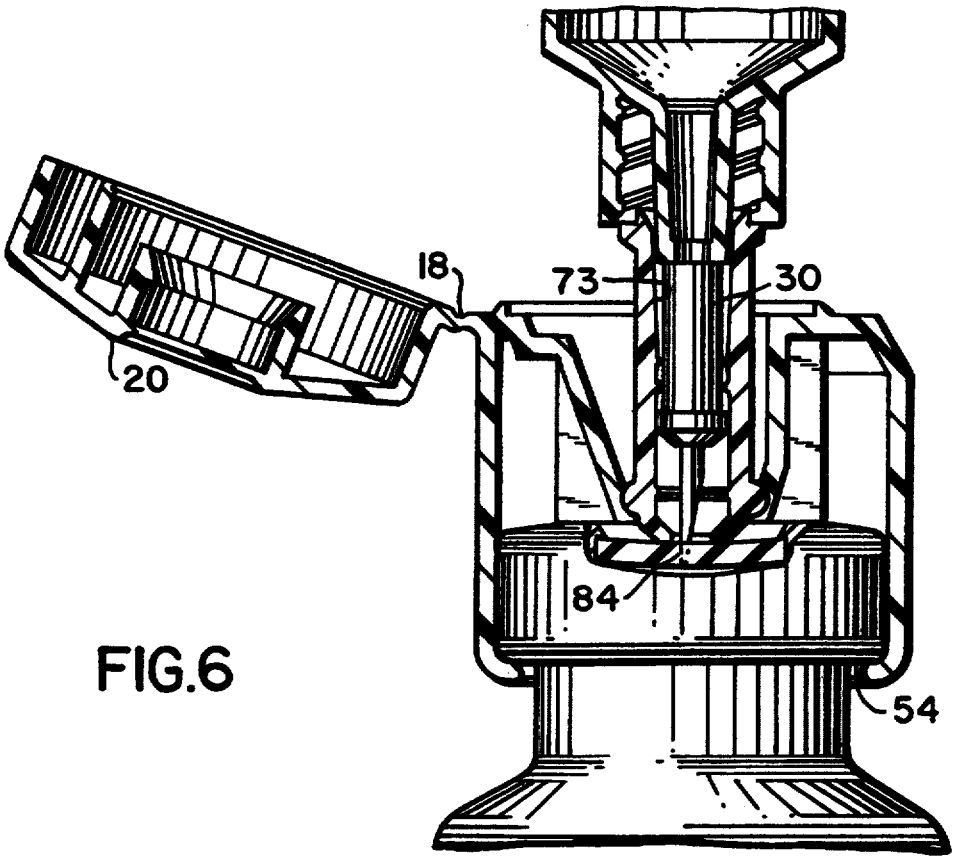
FIG. 6 is a similar side view with the syringe pushing down on the ferrule in the adapter and the lance starting to penetrate the rubber seal of the medicine container.

The cap cover 20 is opened and the syringe 38 screwed onto the outer end 32 of adapter 30. End 45 of syringe shaft 44 bears against the outer end 82 of the ferrule 34 which has the central longitudinal base 80 thus placing the syringe in flow communication with the lance 36. As the syringe 38 is tightened on the adapter 30, it moves downwardly to the positions shown in FIG. 6–7 with the lance penetrating the gasket 12 and latching in the position shown in FIG. 7 with respect to the adapter 30.

The medicine is withdrawn by pulling back on the plunger 40 of the syringe 38 and pulling up.

Figure 7:
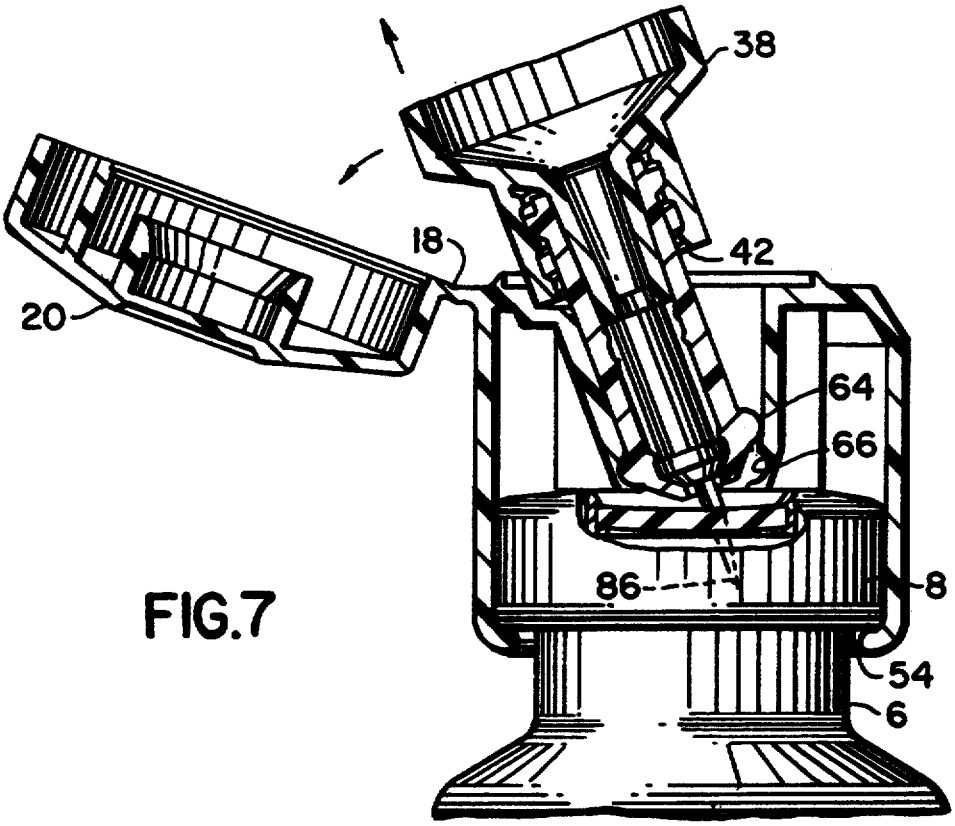
FIG. 7 is a side perspective view of the device and syringe showing the lance of the ferrule through the rubber seal of the medicine vial, the syringe tilted towards the open cap of the device, and the adapter starting to disengage from the grasp of the inner walls of the device.
Figure 10:
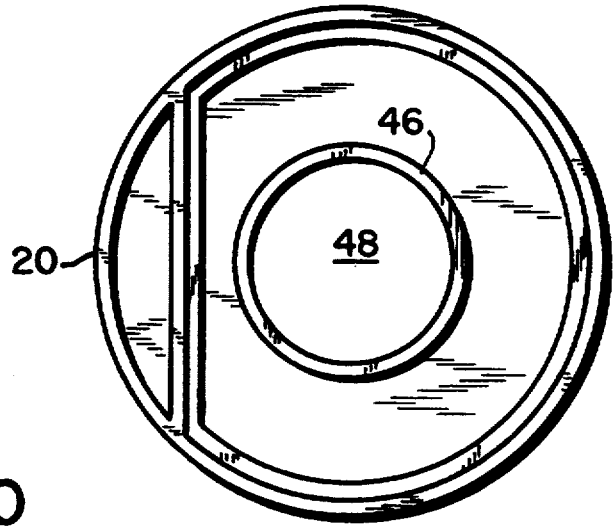
FIG. 10 is the bottom view as the closure cap of the apparatus invention along lines 10—10 of FIG. 2.
Figure 11:
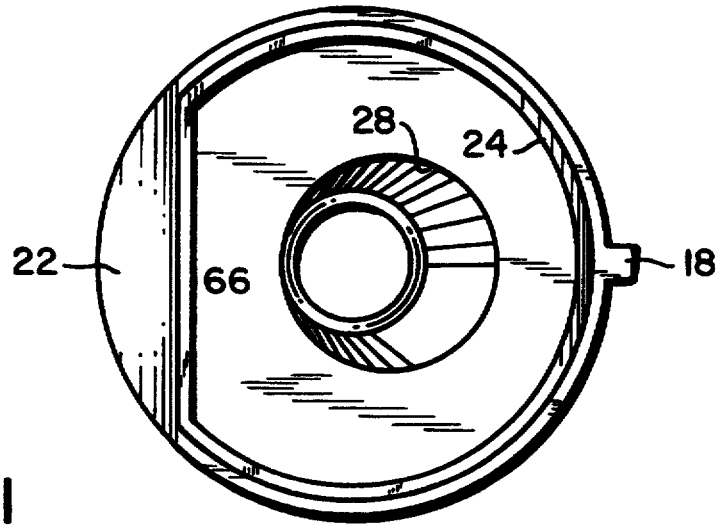
FIG. 11 is the top view of the uncovered surface of the apparatus chassis along lines 11—11 of FIG. 2 with the adapter removed.
Figure 12:
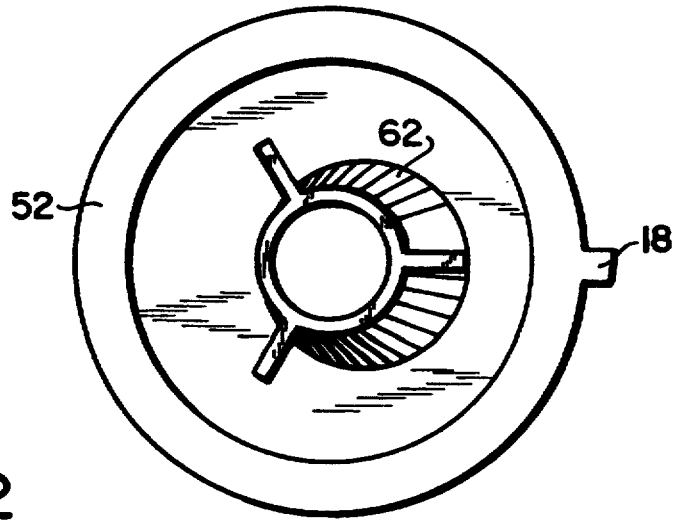
FIG. 12 is a view taken along lines 12—12 of FIG. 2.

A further advantage of the present invention is that the adapter 30 and ferrule 34 may be removed from the device 2 as shown in FIG. 7, 8 and 9 by tilting towards the hinge 18 as shown in FIG. 7.

The device 2 thus provides a convenient and safe way to withdraw medicine from the vial 8 without undue exposure to needles. The device 2 may be capped after use, replacing the adapter 30 and ferrule 34 in place on the chassis 14.

The ferrule 34 will be locked down in the lower position of the adapter 30 spaced from the window 48. Because of the spacing, the colored ferrule 34 will not be visible through the translucent window 48 and the user will know that the vial has been opened previously.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. Apparatus for withdrawing medicine from a vial with a syringe wherein said vial has a necked-in upper section and a penetrable closure gasket at the top of said vial, an interior of said vial, said apparatus comprising a chassis having outer walls with snap on means at the lower end of said outer walls of said chassis for attaching said apparatus to said vial at said necked in section at said top of said medicine vial, generally vertical inner walls of said chassis spaced from said outer walls, a cylindrical Luer lock adapter having cylindrical walls with a male Luer lock means on outer upper surfaces of said adapter, said cylindrical Luer lock adapter mounted to said inner walls of said chassis at the base of said inner walls, said adapter being positioned over said gasket in an upright position, a hollow cylindrical ferrule having a hollow lance at the lower end thereof, said ferrule being positioned within said adapter, said ferrule being movable within said adapter from a recessed position to an extended position within said adapter when a syringe is secured to the outer end of said adapter by female Luer lock means on said syringe cooperating with said male Luer lock means, said syringe thereby moving said ferrule from said recessed position to said extended position, said lance thereby puncturing said gasket and placing said vial interior and said syringe in flow communication with each other.

2. Apparatus as claimed in claim 1 wherein said Luer lock adapter is releaseably mounted to said inner walls of said chassis.

3. Apparatus as claimed in claim 1 wherein an integral cover cap is provided for said chassis.

4. Apparatus as claimed in claim 3 wherein said cap has a translucent window therein.

5. Apparatus as claimed in claim 4 wherein at least the exterior end surface of said ferrule is colored so as to be visible through said cap window when said cap is closed and said ferrule is in the recessed position.

* * * * *